US005120582A

United States Patent [19]

Browning

[11] Patent Number: 5,120,582

[45] Date of Patent: Jun. 9, 1992

[54] MAXIMUM COMBUSTION ENERGY CONVERSION AIR FUEL INTERNAL BURNER

[76] Inventor: James A. Browning, c/o Browning Engineering, P.O. Box A, Enfield, N.H. 03748

[21] Appl. No.: 641,958

[22] Filed: Jan. 16, 1991

[51] Int. Cl.[5] ..... B05D 1/08

[52] U.S. Cl. ..... 427/423; 239/8; 239/13; 239/79; 239/80; 239/85

[58] Field of Search ..... 427/423; 239/79, 80, 239/85, 8, 13

[56] References Cited

U.S. PATENT DOCUMENTS

| | | | |
|---|---|---|---|
| 2,861,900 | 11/1958 | Smith et al. | 117/105 |
| 3,246,114 | 4/1966 | Matvay | 219/76 |
| 3,676,638 | 7/1972 | Stawd | 427/423 X |
| 4,146,654 | 3/1979 | Gvyonnet | 427/423 X |
| 4,805,836 | 2/1989 | Streb et al. | 239/80 |
| 4,869,936 | 9/1989 | Moskowitz et al. | 427/423 |
| 5,014,915 | 5/1991 | Simm et al. | 239/79 |

*Primary Examiner*—Bernard Pianalto
*Attorney, Agent, or Firm*—Sughrue, Mion, Zinn, Macpeak & Seas

[57] ABSTRACT

A compressed air with or without water droplets in mist form and additional pure oxygen is passed over the radially exterior hot surfaces of an expansion nozzle having a L/D ratio of at least 3-to-1 and preferably surrounded by thermal insulation to enhance regenerative heat exchange between the expansion nozzle and the compressed air stream, as well as regenerative heat exchange with the exterior of a combustion chamber wall of an internal burner, also surrounded by thermal insulation prior to the compressed air entering the combustion chamber for ignition with a mixture of fuel. This permits large operating economics to be realized, reducing the need for expensive pure oxygen as the oxidant and permits the elimination of forced cooling by confined water flow for such internal burners.

12 Claims, 1 Drawing Sheet

MAXIMUM COMBUSTION ENERGY CONVERSION AIR FUEL INTERNAL BURNER

FIELD OF THE INVENTION

The present invention is directed to an internal burner which makes use of regenerative air cooling together with a thermal insulation shield to maximize the useful energy release from an essentially stoichiometric flow of fuel to an air-fuel internal burner producing supersonic flame jets for flame spraying applications.

BACKGROUND OF THE INVENTION

In the past, the HVOF (hypersonic velocity oxy-fuel) continuous spraying of higher melting point powdered materials such as tungsten carbide (in a cobalt matrix) has required the use of oxidizers of much higher oxygen content than that contained in air. For example, in my earlier U.S. Pat. Nos. 4,416,421; 4,634,611; and 4,836,447 in particular, show forms of flame spray devices described as primarily oxy-fuel burners. Air may be one component of the oxidizer flow, but in each case the intensity of the flame jet relies on oxygen percentages greater than that contained in ordinary compressed air. The use of air to cool heated burner parts with this air subsequently entering and supporting the combustion process (regenerative cooling) was not feasible.

In place of "regenerative cooling", where the coolant becomes the oxidizing reactant, these prior flame spray devices rely on forced water cooling which severely limits the peak temperatures and jet velocities theoretically attainable. As an example, using a commercially available HVOF flame spray unit of the type discussed in U.S. Pat. No. 4,416,421, a simple heat balance shows that approximately 30% of heat released during the combustion process is carried away by the cooling water. Assuming a combustion peak flame temperature of 4,700 degrees Fahrenheit for a pure oxygen-propane mixture burning at a chamber pressure of 60 psig. if flame temperature was linearly related to heat content, then the 70% availability of the useful heat achieves a maximum flame temperature of only 3,150 degrees Fahrenheit. Of course, dissociation effects which limit the peak achievable temperature to 4,700 degrees F. release heat upon cooling. Thus, an actual combustion temperature of around 3,600 degrees F. is estimated.

Examining the combustion of compressed air and propane under conditions of essentially zero heat loss, the peak theoretical combustion temperature is about 3,400 degrees F. This is only 200 degrees F. less than that of the pure oxygen burner described above.

SUMMARY OF THE INVENTION

This invention provides an internal burner capable of flame spraying nearly all the high melting point materials previously only sprayed using devices operating with oxygen contents greater than that contained in ordinary compressed air. Needless to say, large operating economics are realized where expensive pure oxygen is not required and simplicity and reliability of the operation are greatly enhanced by eliminating forced cooling water flow for such burners.

BRIEF DESCRIPTION OF THE DRAWINGS

The single

DESCRIPTION OF THE PREFERRED EMBODIMENT

Figure 1:
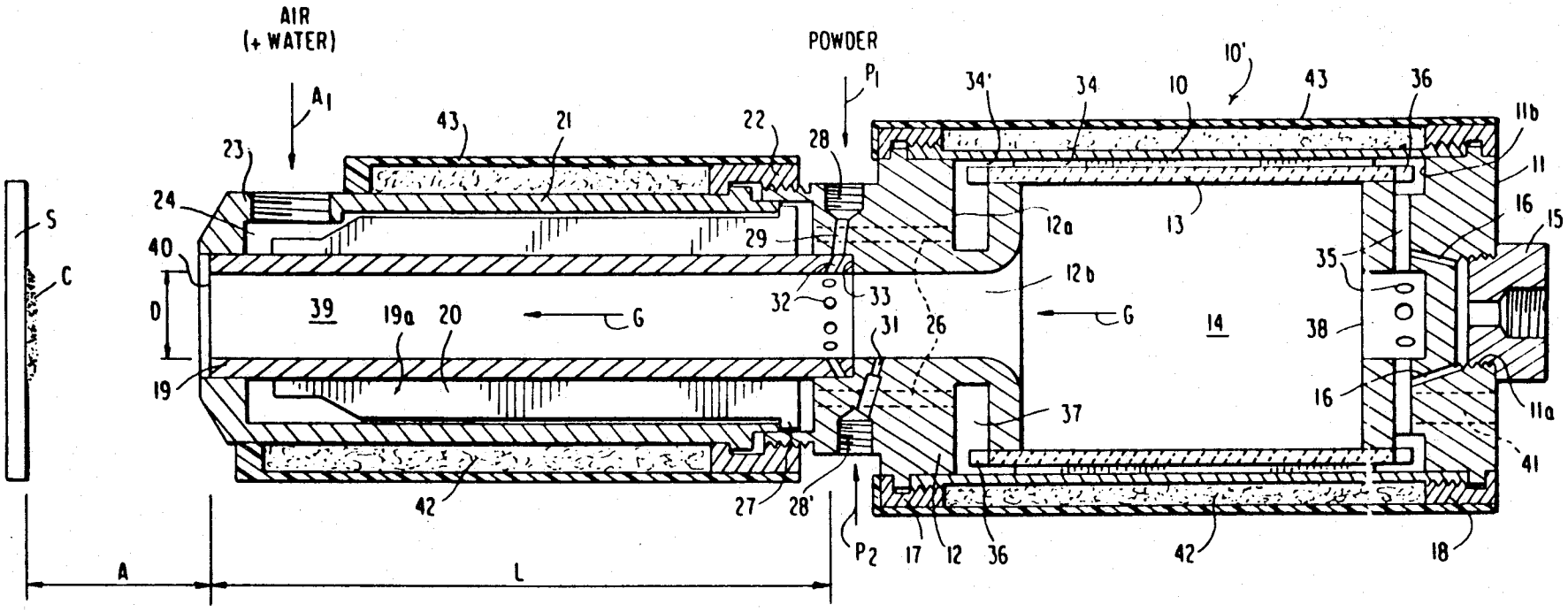
FIG. 1 is a longitudinal sectional view of the internal burner forming a preferred embodiment of the invention.

A better understanding of the invention may be obtained via the FIG. 1 cross-sectional view of the burner of the invention. In the figure flame spray burner 10' comprises an outer shell piece 10 to which the cylindrical flame stabilizer 11 and nozzle adaptor 12 are threadably connected by nuts 17 and 18.

Nozzle 19 pressure-seats against face 33 of adaptor 12 by means of nut 22 which presses outer cylindrical casing 21 against multiple shoulders 27 of multiple fins 20.

Compressed air, with or without mist cooling water passes through adaptor 23 to annular volume 24 defined by nozzle tube 19 and casing 21. The air then passes at high velocity through narrow slots **19*a* forming fins 20 to provide cooling of nozzle 19. From the slots the air passes through multiple longitudinal holes 26 in cylindrical adaptor 12 to annular volume 37 formed by a radial groove in adaptor 12 and thence through the narrow annular space 34' contained between shell 10 and combustor tube 13. The air, after cooling both adaptor 12 and combustor tube 13, passes radially through multiple circumferentially spaced radial holes 35 to stabilization well 38 formed by an axial bore in cylindrical stabilizer 11, while cooling stabilizer 11**.

Fuel for combustion enters stabilizer 11 through adaptor 15 threaded into a tapped axial bore **11*a* of stabilizer 11 and thence through multiple oblique passages 16 into corresponding radial holes 35 to mix with the air passing to well 38 through holes 35. Ignition in combustion chamber volume 14 is effected by a spark plug (not shown) or by flashback from outlet 40 of nozzle passage or bore 39**.

Combustor tube 13, usually made of a refractory metal such as 310 stainless steel has thin circumferentially spaced ridges 34 projecting radially outwardly thereof to provide adequate radial spacing between tube 13 and shell 10. Tube 13 operates at a red heat, expanding and contracting as the burner is turned "on" and "off". It must be provided with adequate space to allow free expansion. Shoulders 36 at opposite ends of tube 13 are notched to prevent air flow cut-off in the event of tube axial expansion against adjacent faces **11*b*, 12*a* of elements 11 and 12. The combustion chamber 14 pressure is maintained between 50 psig and 150 psig when compressed air, alone, is the coolant. At greater pressures air cooling is not adequate. A small amount of water, as per arrow pre-mixed into the air $A_1$ prior to entry to adaptor 23** helps to film cool the heated elements of the burner. A quantity of water which does not lower the oxygen content by weight in the total air-water mixture to less than 12% can be used without need for pure oxygen addition. Such operation is adequate for spraying, as per arrow P, powders such as aluminum, zinc, and copper as even the lowered temperature is capable of adequate heating of such powder. For higher melting point powders such as stainless steel and tungsten carbide it is necessary to add pure oxygen to the air at $A_1$ to provide the higher temperatures required. At very high pressure the air-contained oxygen will not, in itself, support combustion as the water content will be too great. Thus, under such conditions pure oxygen must be added to keep the total percentage-by-weight of oxygen above 12% in the total mixture.

In some cases the increased cooling required may be met by increasing the inlet air flow $A_1$ substantially effecting better cooling of the structural elements. This added air is, later, discharged to the atmosphere prior to the point where fuel is injected. In FIG. 1, a dotted line longitudinal bore 41 within flame stabilizer 11 forms the discharge passage for this extra air flow. A valve therein (not shown) controls the discharge flow rate.

The high temperature products of combustion expand to atmospheric pressure in their passage through nozzle bore 39. Powder is introduced essentially radially into these expanding gases through either of two powder injector systems shown in FIG. 1. Where a forward angle of injection of the powder is desired (in the direction of gas flow), powder passes, as per the arrow $P_1$ labeled "POWDER", from a supply tube (not shown) threadably attached to tapped hole 28 and thence through passage 29, open thereto, abutting the outer circumference of nozzle 19. One of the several oblique injector holes 32 is aligned with hole 29. A carrier gas, usually nitrogen, under pressure forces the powder into the central portion of the hot gas flow.

Where a rearward angle of injection of the powder is desired to increase particle dwell time in its passage through nozzle bore 39, a second injector system is utilized. From hole 28' the particles are forced by carrier gas flow, arrow $P_2$, through an oppositely oblique injector hole 31, into the hot gas exiting nozzle bore **12*b* of adaptor 12, sized to nozzle bore 39** and aligned therewith.

An advantage of the injection system using multiple injectors contained in replaceable nozzle 19 is that when one injector hole erodes by powder scouring to too large a diameter, a second hole 32 of correct size is alignable thereto, to accept powder flow from hole 29. Also, the injector holes 32 may provide different angles of injection as required to optimize the use of powders of different size distribution, density, and melting point. For example, for a given nozzle length "L", aluminum should have a much shorter dwell time in the hot gases than stainless steel. A sharp forward angle would be formed for aluminum in contrast to a closer-to-radial angle for stainless steel.

Any material being sprayed $P_1$, $P_2$ must be provided with an adequate dwell time to reach the plastic or molten state required to form a coating upon impact with a surface being spray-treated. As discussed in my U.S. Pat. No. 4,416,421, spraying of higher melting point materials using oxy-fuel flames requires L/D ratios for nozzle 19, bore 39 and that at **12*b* with adaptor 12**, greater than 5-to-1. The compressed air burners have been found to require about the same length nozzles as priorly used with pure oxygen units. As the air burner nozzles are, usually, about twice the diameter of their oxygen counterparts, the L/D ratio is reduced to 3-to-1.

The L/D ratio is determined by the effective length of the bore 39 from the point of introduction of the powder via a radial passage 32 into the nozzle 19 and its outlet or exit at 40, while the diameter D is the diameter of that bore. Such ratio is critical in ensuring that the particles are effectively molten or near molten at the moment of impact against the substrate S downstream from the exit 40 of nozzle bore 39.

Although the inventor has had a great deal of prior experience in the design of regeneratively-cooled compressed air internal burners, until recently the inventor did not appreciate that when used with extended nozzles, such internal burners would be adequate for spraying other than low melting metals in the form of wires or rods. In fact, the ability of such internal burners to spray tungsten carbide was discovered due to an error when the tungsten carbide was placed in the powder hopper in place of a lower melting point stainless steel.

Nozzle lengths with D/L ratios of over 15-to-1 were originally required to spray tungsten carbide powder successfully using the compressed air internal burner. By reducing the area of heat loss surface, increased flame temperatures were achieved. This achievement results mainly from increasing the combustor tube 13 diameter-to-length ratio. A classical calculus problem to determine the minimum wetted surface of a cylindrical container such as a can of food of given volume leads to the "tuna can" solution where the diameter is double the can's height. For a flame spray unit requiring, say, a combustion volume of 36 cubic inches, many choices involving diameter-to-length ratios exist. For example, the diameter may be 3 inches with a length just over 5 inches, or the "tuna can" solution of D=4.16 inches and L=2.08 inches. The latter diameter is too great as the copper pieces 11 and 12 are not routinely available in this large a diameter and the unit becomes awkward and heavy. The diameter-to-length ratio of 3-to-5 (that actually used) remains much smaller than previously used by the inventor in other applications of these devices not demanding maximum temperature attainment.

Even though the main loss of heat (that to a water coolant) has been eliminated by regenerative coolant flow of the combustion air, the outer surfaces of the burner reach high temperature during use and radiant heat loss of between 3% and 5% is estimated. Elimination of this loss by adequate thermal insulation means is necessary to reach maximum performance of the spray system. For this purpose, the outer surfaces of pieces or elements 10, 11, 12, and 21 are enclosed in a sheath of high-temperature thermal insulation material such as silica wool 42 covered by a sheet or coating 43. Nuts 17, 18, and 22 and other parts are also preferably coated with such temperature-resistant plastic as 43. It is believed that such thermal insulation of a flame spray internal burner is unique.

Example of a Flame Spray Burner of this Invention

An example of a successful operating system is now provided using the burner 10; provided with 150 scfm of compressed air at 100 psig and propane at 60 psig to yield a combustor chamber 14 pressure of about 50 psig. Under stoichiometric conditions the gas temperature entering nozzle bore 39 from bore **12*b* adjacent to chamber 14 was about 3,200 degrees F. These hot gases expand to a lower temperature within the ¾-inch diameter combined nozzle bore 12*b*, 39 of 6-inch length until a Mach 1 flow region is attained. The temperature is, now, approximately 2,900 degrees F. for the remainder of the passage through the nozzle bore 39**. For the 6-inch nozzle, successful spraying of both tungsten carbide and stainless steel powders $P_1$ were achieved. In fact, it appears that each coating C is at least as dense as when sprayed using the oxy-fuel counterpart. For the case of the stainless steel, nearly no oxides were visible in photomicrographs. There is much less overheating.

The Mach 1 flow within the nozzle bore 39 is at a velocity of about 2,750 feet per second and expands beyond the nozzle exit 40 to M = 1.65 (4,200 ft/sec). The sample substrates being sprayed was held a distance A = 1 foot away from the burner allowing the particles to reach velocities greater than 2,000 ft/sec. This is comparable to those achieved using pure oxygen systems.

The conditions of air and fuel pressure of the example are in the range of those oxy-fuel units currently in commercial use. Pressure increase to very high levels is a simple matter using compressed air and fuel oil in place of propane. For a combustion pressure of 1,200 psi with chamber 14, the fully expanded Mach No. is 4.5 (7,400 ft/sec). This leads to particle impact velocities on substrates of over 4,000 ft/sec, a value never achieved before. Coatings C have been found to improve in quality nearly directly proportional to impact velocity. Compressed air $A_1$ use above 500 psig therefore opens up a new area of technology in the flame spray field.

By choice of nozzle material and the amount of cooling provided by the compressed air $A_1$ (and mist) flow, it is possible to vary the inner nozzle surfaces of nozzles 19, **12*b* to a wide range of temperatures. Where coolest possible nozzle surfaces are desired—as nozzle 19 for spraying plastics, zinc, and aluminum from the nozzle bore 39, copper is the ideal material for forming the nozzle 19 bore 39 with maximum cooling provided. However, for high melting point materials such as stainless steel, tungsten carbide, the ceramics, and the like, it is desirable to maintain the inner nozzle 19 surface of bore 39 as at high a temperature possible. For this case, a refractory metal such as 316 stainless steel is used with either no cooling fins 20, or radially short end fins. Under these conditions, the inner nozzle bore 39 surface runs bright red at very high temperature. Heat losses from the hot product of combustion gas G are greatly reduced, thus maintaining a higher gas temperature throughout the nozzle length L. Also, radiation cooling of the heated particles is reduced substantially. Such use can allow the effective nozzle length to be cut in half and nozzle 19** is capable of spraying higher melting point materials than highly cooled copper nozzles.

What is claimed is:

1. A flame spray method using a regeneratively cooled internal burner having a body including a combustor forming a closed combustion chamber, said method comprising the steps of:

cooling the burner body with and feeding compressed air as the coolant/oxidizer with one of a gaseous and liquid fuel into said combustion chamber by passing said compressed air in contact with critically heated burner elements of said body to provide adequate cooling of said elements while at the same time regeneratively heating the coolant air flow to high temperature, prior to feeding said compressed air into said closed combustion chamber, to affect rapid combustion reactions within said closed combustion chamber, expanding the hot gaseous products of combustion from a terminal face of said combustor through a restricting nozzle having a bore with an L/D ratio of 3 or greater, passing a powder flow of the material to be sprayed into said heated gas flow of said products of combustion at a point at least proximate to the nozzle bore entry, whereby said heated gas flow heats said particles to at least the plastic state while at the same time accelerating the particles to greater than 1,500 feet per second for impact against a surface of a substrate to be spray coated downstream of an exit of said restricting nozzle.

2. The method of claim 1, wherein said step of passing powder comprises injecting particles by a cold gas flow into said high-velocity products of combustion through a given one of several injector holes contained in a replaceable nozzle element, and selecting said injector hole by rotatively repositioning said restricting nozzle to a powder feed system passage contained in said burner body.

3. The method as claimed in claim 2, wherein the several injector holes are contained in said nozzle element at different injector entry angles to the axis of said restricting nozzle bore and said step of passing powder comprises rotatively aligning said nozzle element with said passage in said body for effecting particle flow in a desired direction into said nozzle bore.

4. The method as claimed in claim 1, further comprising the step of adding a suspension of water droplets to the compressed air flow to form a mist to increase cooling by applying a cooling film to said elements, whereby the combustion pressure of the combustor may be increased such that the regenerative air cooling absent the mist is insufficient to prevent heat damage to one or more elements comprising the burner, and limiting the amount of water droplets forming said water mist to ensure proper combustion reactions of air and fuel with said combustion chamber.

5. The method of claim 4, further comprising the step of introducing additional oxygen to said combustion chamber in the form of pure oxygen mixed into the compressed air flow to prevent the volume of said water mist relative to compressed air to adversely affect said combustion reactions.

6. The method as claimed in claim 4 utilizing regenerative cooling of the internal burner by a compressed air flow augmented by a water mist contained in said air flow, further comprising the step of maintaining the pressure within the combustion chamber during air fuel combustion at a pressure in excess of 300 psig.

7. The method as claimed in claim 4, further comprising the step of maintaining the pressure within the combustion chamber during air fuel combustion at a pressure in excess of 500 psig.

8. The method as claimed in claim 1, further comprising the steps of; adding an additional flow of inlet air to the combustion chamber to achieve increased cooling of said body burner elements to prevent heat damage to at least one of the elements, and discharging a greater-than-stoichiometric flow of air to the atmosphere prior to the injection of fuel into said combustion chamber.

9. The method of claim 1, further comprising the step of thermally insulating the radially outer surfaces of the heated burner elements of at lest said internal burner to increase the regenerative heat exchange between the coolant air flow prior to the entry thereof into said closed combustion chamber and the expanding hot gaseous products of combustion from the terminal face of said combustor through said restricting nozzle.

10. The method of claim 9, further comprising thermally insulating the radially outer surface of the restricting nozzle and passing said compressed air in contact with a radially exterior surface of said restricting nozzle prior to passing the compressed air in contact with the critically heated burner elements of the body to increase the regenerative heat exchange between said compressed air and the expanding hot gaseous products of combustion passing through said restricting nozzle.

11. The method as claimed in claim 1, wherein the length-to-diameter ratio of the combustion chamber is less than 2:1.

12. The method as claimed in claim 1 comprising operating the inner surface of said restricting nozzle above 1,200 degrees F., thereby improving the flame spraying of a powdered material in a regeneratively cooled system, while reducing heat losses from the high-velocity gas flow passing through the elongate nozzle bore to the coolant as well as reducing radiant heat loss from the spray material to the bore inner wall of said elongate restricting nozzle.

* * * * *